US005660091A

United States Patent [19]

Stone et al.

[11] Patent Number: 5,660,091

[45] Date of Patent: Aug. 26, 1997

[54] BLUNT-NOSED, SELF-RETAINING SCREWDRIVER

[75] Inventors: Kevin T. Stone; Jeffrey A. Duncan, both of Jacksonville; Timothy J. Case, Fernandina Beach, all of Fla.

[73] Assignee: Walter Lorenz Surgical, Inc., Jacksonville, Fla.

[21] Appl. No.: 598,484

[22] Filed: Feb. 8, 1996

Related U.S. Application Data

[60] Provisional application No. 60/011,239 Feb. 6, 1996.

[51] Int. Cl.[6] ..... B25B 23/00

[52] U.S. Cl. ..... 81/460; 81/451

[58] Field of Search ..... 81/436, 451, 460

[56] References Cited

U.S. PATENT DOCUMENTS

| | | | |
|---|---|---|---|
| 2,046,837 | 7/1936 | Phillips | 145/50 |
| 2,046,838 | 7/1936 | Phillips | 145/50 |
| 2,046,839 | 7/1936 | Phillips | 85/45 |
| 2,046,840 | 7/1936 | Phillips | 145/50 |
| 2,474,994 | 7/1949 | Tomalis | 85/45 |
| 2,592,462 | 4/1952 | Phipard | 85/45 |
| 2,601,453 | 6/1952 | Phipard | 145/50 |
| 2,646,829 | 7/1953 | Phipard | 145/50 |
| 2,764,197 | 9/1956 | Torresen | 145/50 |
| 3,037,539 | 6/1962 | Johnson et al. | 81/460 |
| 3,654,974 | 4/1972 | Barnes | 81/460 |
| 3,658,105 | 4/1972 | Burt et al. | 81/460 |
| 4,187,892 | 2/1980 | Simmons | 145/50 |
| 4,325,153 | 4/1982 | Finnegan | 7/165 |
| 4,970,922 | 11/1990 | Krivec | 81/460 |
| 5,291,811 | 3/1994 | Gross | 81/460 |
| 5,528,966 | 6/1996 | Coppejans | 81/460 |

OTHER PUBLICATIONS

W.Lorenz catalog, 1.5/2.0 Omm Combination Titanium Osteosynthesis System, copyright 1994, Walter Lorenz Surgical, Jacksonville, FL, 16 pages.

*Primary Examiner*—James G. Smith

*Attorney, Agent, or Firm*—Woodward, Emhardt, Naughton, Moriarty & McNett

[57] ABSTRACT

A self-retaining screwdriver having a plurality of diametrically opposed, radially extending blades on its tip for engagement with corresponding slots of a screw or other fastener, wherein the blades vary radially in thickness. The screwdriver also includes diametrically opposed, radially extending blades of constant thickness arranged perpendicular to the blades of radially varying thickness. Tapered blades having a thickness which increases with distance from the screwdriver axis are disclosed in one embodiment in which the blades also have a convex end surface, for use with a screw having a convex head.

33 Claims, 3 Drawing Sheets

BLUNT-NOSED, SELF-RETAINING SCREWDRIVER

CROSS-REFERENCE TO RELATED APPLICATION

This application is a continuation-in-part of a provisional application No. 60/011,239 filed Feb. 6, 1996 in the names of Stone, Duncan and Case, the inventors named herein.

BACKGROUND OF THE INVENTION

This invention relates to screwdrivers and, more particularly, to self-retaining screwdrivers.

Numerous self-retaining screwdrivers have been proposed in the past, as exemplified by the devices disclosed in the following patents:

| Patent No. | Name | Issue Date |
|---|---|---|
| 2,474,994 | Tomalis | July 5, 1949 |
| 2,646,829 | Phipard | July 28, 1953 |
| 4,187,892 | Simmons | Feb. 12, 1980 |
| 4,325,153 | Finnegan | Apr. 20, 1982 |
| 4,970,922 | Krivec | Nov. 20, 1990 |
| 5,291,811 | Goss | Mar. 8, 1994 |

One well-known technique for retaining a screw on a screwdriver involves the use of a magnetized bit on the screwdriver. Another conventional technique involves the use of one or more clips or fingers mounted on the screwdriver so as to extend around the head of an attached screw and grip the underside of the screw head.

Wedging action has also been employed in a number of self-retaining screwdrivers. The blade or blades on such a screwdriver typically vary in thickness in an axial direction, whereby the driver bit wedges into an interference fit in the slotted recess of the fastener. Each slot of the fastener has to be wide enough to accommodate the extreme tip of the bit, but must be narrow enough to facilitate the wedging action.

A steep axial taper on a blade can enhance wedging action, but, with such a considerable inclination between the longitudinal axis of the driving tool and the plane of the blade performing the wedge function, there is a "throw-out" effect, that is, an axial thrust component which increases with driving torque and tends to force the driver out of the screw slot. This not only inhibits the ability to drive the screw any further, but also can ream or mar the slot and also damage the driver bit. The driver blades can be made to vary axially in thickness more gradually to minimize such effects, but such a screwdriver would only retain a screw with a correspondingly deeper slot, which makes the screw correspondingly weaker, or a correspondingly narrower slot, which would adversely affect the ease of initial entry of the driver bit into the slot.

SUMMARY OF THE INVENTION

The present invention overcomes these and other disadvantages of the prior art by providing a self-retaining screwdriver having a plurality of radially extending blades on the tip of a shaft, at least one of the blades varying radially in thickness.

The term "screwdriver" is used herein to mean a driving tool which has a bit portion engageable in a complementary recess in the head of a rotatably driven member, which is most commonly a threaded fastener such as a screw, a bolt or the like.

A general object of the present invention is to provide an improved self-retaining screwdriver.

A further object of the invention is to allow a significantly reduced head profile for the driver.

Other objects and advantages of the present invention will be apparent upon reading the following detailed description in conjunction with the accompanying drawings.

DESCRIPTION OF THE PREFERRED EMBODIMENT

Figure 1:
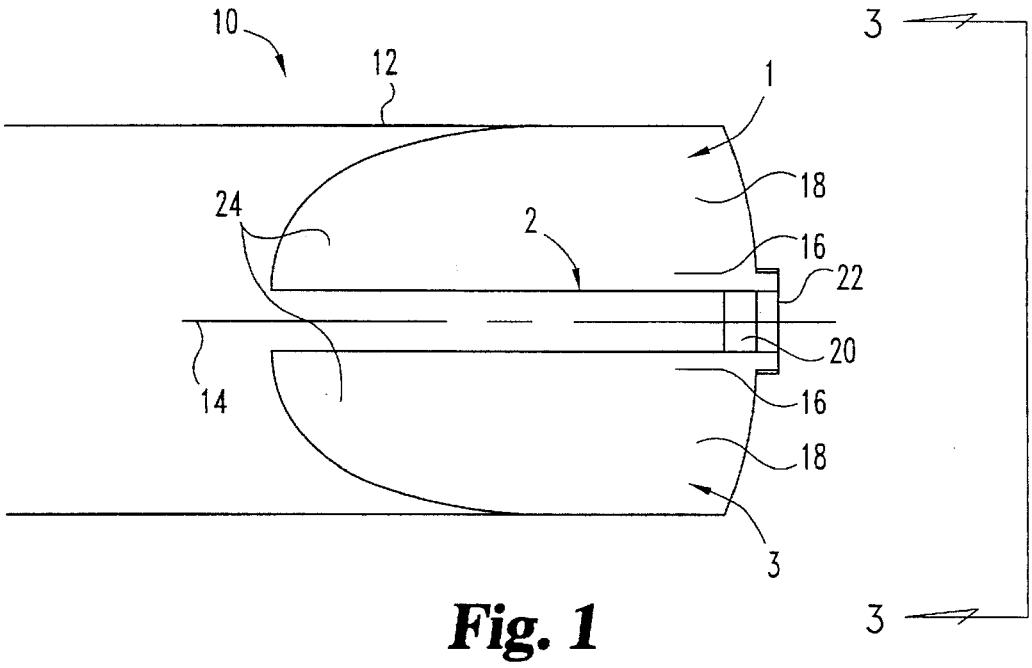
FIG. 1 is a fragmentary, top view showing a profile of the tip portion of the preferred embodiment of a self-retaining screwdriver according to the present invention.
Figure 2:
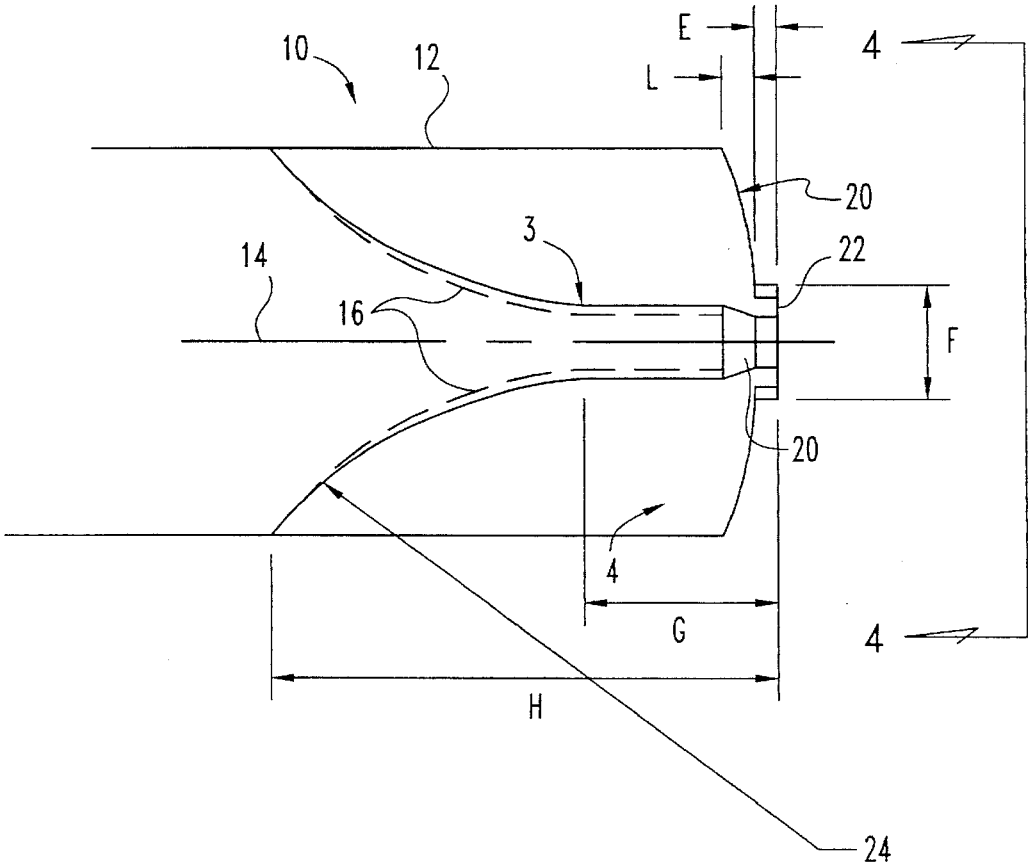
FIG. 2 is a side view of the screwdriver tip of FIG. 1.
Figure 3:
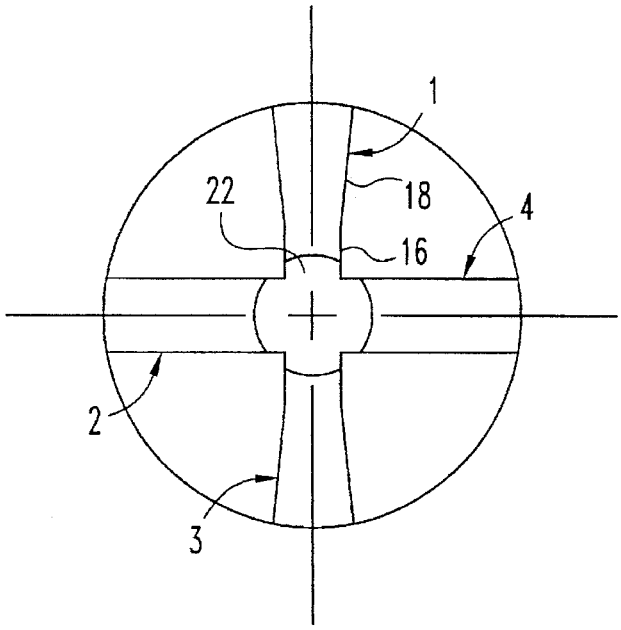
FIG. 3 is an end view of the screwdriver tip taken along lines 3—3 of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The screwdriver bit 10 shown in FIGS. 1–4 has four ribs or blades 1, 2, 3, and 4 extending radially outward to the outer periphery of the driver shaft 12, two of the blades (1 and 3) varying radially in thickness, i.e., varying in thickness with distance from the axis of the shaft. The thickness of blades 2 and 4 in the disclosed embodiment is constant. The variation in thickness of the two diametrically opposed blades 1 and 3 is illustrated by phantom lines in FIG. 2 and is also readily apparent in FIG. 4, for example, where it can be seen that those two blades have an inner portion 16 of constant thickness and an outer tapered portion 18, with an angle of 12° between the side walls of each tapered portion as illustrated. The dimensions vary with the overall size of the driver, of course, but, as one example, the tapered blades 1 and 3 each have an inner portion 16 of uniform thickness extending 0.015" to either side of the two other blades on the bit, as indicated by the lines for dimension A in FIG. 4. Blades 2 and 4 are each nominally 0.0193" thick (dimension B). The thickness of the tapered blades varies from 0.015" nominally to 0.0219" nominally, as indicated by dimension lines C and D.

Figure 5:
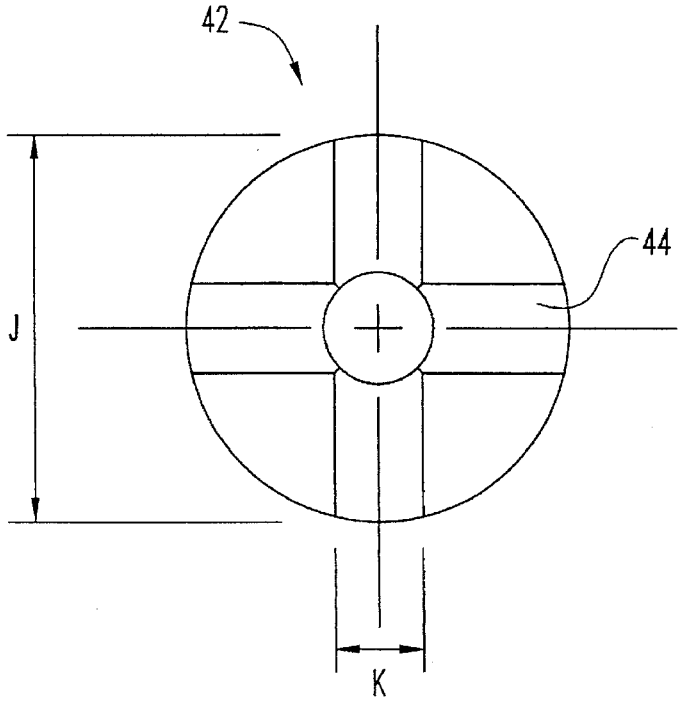
FIG. 5 is a side view of a screw compatible with the screwdriver of the present invention.
Figure 6:
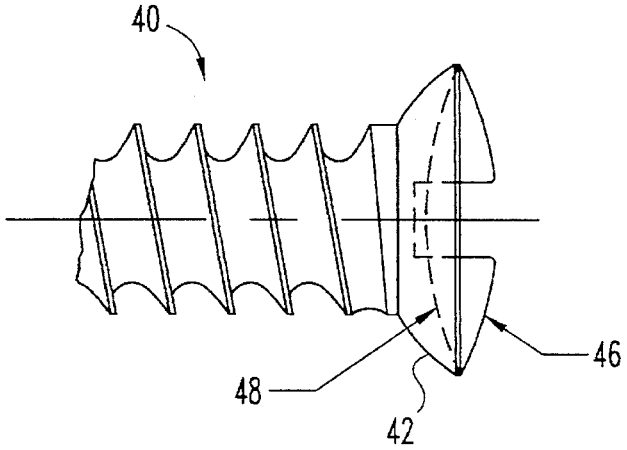
FIG. 6 is an end view of the screw taken along lines 6—6 of FIG. 5.

A convex curve 20 is preferably provided on the end surface of each blade to facilitate entry into and retention of the head of a screw 40 of the type disclosed in FIGS. 5 and 6, that screw preferably also having a convex head 42 as shown. A radius of curvature of 0.172" has been found suitable for the convex end surfaces 20 of the driver blades. A nose piece 22 extending approximately 0.007" beyond the blades and having a diameter of approximately 0.033" (dimensions E and F, respectively) is provided as a pilot device to facilitate initial entry into the screw head.

The screw of FIGS. 5 and 6 has four identical slots 44 and a maximum slot depth of approximately 0.027", and thus, of course, the driver bit is incapable of extending further into the screw. However, the blade thickness does not vary with respect to axial position for a conservative distance of approximately 0.050" from the tip (dimension G), at which point a curved surface 24 begins on the rear portion of the tapered blades as perhaps best shown in FIG. 2. The radius of curvature of the curved surface 24 is approximately 0.125", and it extends a distance of approximately 0.150" (dimension H).

Figure 4:
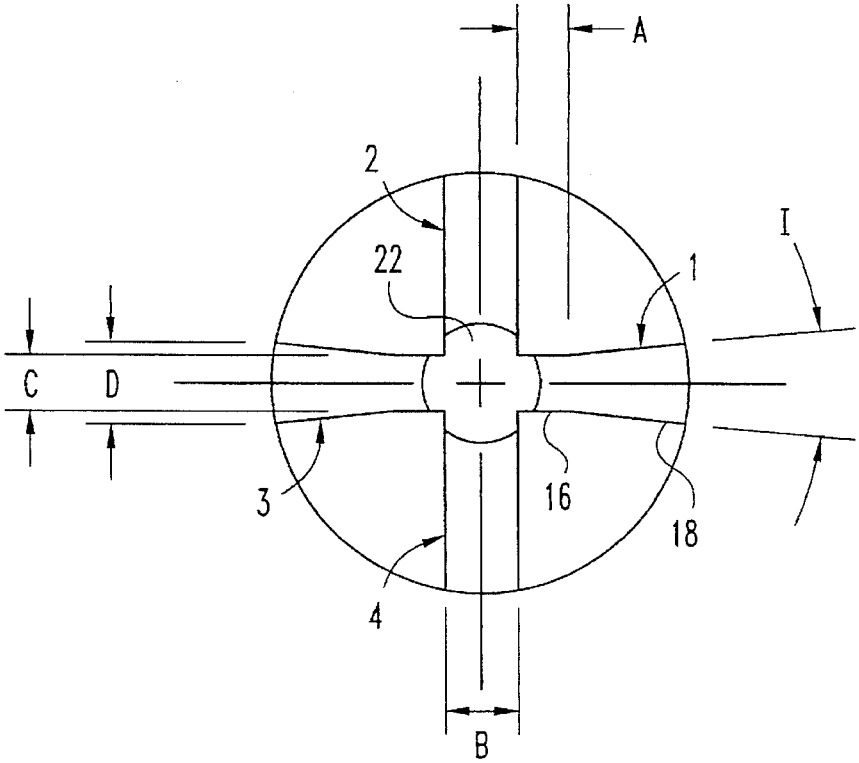
FIG. 4 is an end view of the screwdriver tip taken along lines 4—4 of FIG. 2.

Curved surface 24 is not essential for the practice of the present invention and is provided primarily for ease of manufacturing. More specifically, the grooves or flutes defining the blades are cut into a solid shaft of 440C stainless steel, which initially has a circular nose piece 22 on the tip thereof, using an end mill with a cylindrical tip portion and a frustoconical or dovetail portion immediately adjacent thereto, the dovetail portion tapering outwardly toward the tip portion at a 6° angle with respect to the longitudinal axis of the end mill so as to provide a 12° angle between the blade walls as shown in FIG. 4 (dimension I). The tip portion of the end mill has a constant diameter for a distance of 0.015" to provide the constant-diameter portion 16 of the two tapered blades. With reference to FIG. 1, the end mill is oriented perpendicular to the axis of the driver shaft, with its tip toward the shaft axis and at the desired distance from the shaft axis to define one side wall surface of blade 2. Relative motion between the end mill and the driver shaft along the axis of the shaft causes the shaft to be milled down to a flat surface 16 perpendicular to and extending axially along the side wall of blade 2, which is defined in the same motion, and a tapered surface 18 on blade 1. The curved surface 24 is essentially a byproduct of this milling operation.

The driver bit is preferably heat treated at 1900° F. and tempered one hour at 500° F., and also subjected to a fine ceramic blast with Zirblast B-60.

Referring again to FIGS. 5 and 6, the screw disclosed as an example has a radius of curvature of approximately 0.113" on the outer surface 46 of its head and a radius of curvature of approximately 0.156" on the seat 48 of the slot 44. Alternatively, if desired, the curvature of the seat may be made to match that of the end surface 20 of the driver blades. The overall diameter of the screw head is approximately 0.117" (dimension J), and the screw slots are each approximately 0.020" wide from end to end and top to bottom (see, e.g., dimension K). The outer diameter of the driver bit is approximately 0.115" in the disclosed example. With this outer diameter and a 0.172" radius of curvature for end surfaces 20 as described above, the end surfaces each have an axial span of 0.01", as indicated by dimension L in FIG. 2.

In operation, as the four blades of the disclosed driver begin to enter the corresponding slots of the disclosed screw head, all four blades initially pass freely into their respective slots. Blades 2 and 4 continue to pass freely as the driver bit is moved axially into the screw head because there is a slight clearance between them and their respective slots 44. However, the tapered blades engage the slot walls prior to contact with seat 48, at the point at which the thickness of the tapered blade portion which is within the slot equals the slot width, as will be described, and thereby results in an interference fit. Thus the screw is retained on the end of the screwdriver and may be maneuvered into a desired position with one hand. A particularly preferred application of the present invention is in surgical procedures, where the operating space is very limited and single-handed operation is particularly useful.

The depth of engagement of the driver bit into the screw slot is a function of several dimensions, including the slot width, the blade taper angle, the minimum thickness of the tapered portion and its distance from the axis, the radius of curvature of the end surface of the blade, and the radius of curvature of the screw head. The example set of dimensions given above produces a depth of engagement of approximately 68% of the axial distance from the outermost surface of the screw head to the seat of the slot. This is desirable for nominal values so that the depth of engagement can be maintained within a preferred range. While acceptable operation for some uses can be obtained with as little as 20% penetration and up to virtually 100%, the depth of engagement is preferably in the range of approximately 50–85%, and manufacturing tolerances are preferably set accordingly. Below 50% or so, stripping tends to occur easily, whereas engagement above 85% or so tends to make the retention less reliable than desired.

The screwdriver has also been constructed with a smaller taper angle, i.e., approximately 8°. This embodiment is also considered suitable for some applications although its depth of engagement ranges approximately from 30% to 90% with manufacturing tolerances comparable to those which produce a range of approximately 50–85% in the other embodiment.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the principles of the invention also apply to different screw head shapes, including flat heads and concave heads. In the case of a concave screw head, a driver bit with a concave end and a pair of tapered blades which are thicker toward the center than at the outer periphery may be employed. For a flat head screw, a convex driver bit surface with greater convexity may be employed.

It will be further understood by those skilled in the art that, while the invention has been described in terms of a cross-drive bit, the principles of the invention are equally applicable to screwdrivers having less than or more than four blades, including a conventional straight-blade screwdriver, which, in the terminology employed herein, is viewed as having two diametrically opposed blades. It will also be understood that the invention contemplates at least one blade, and preferably a pair of diametrically opposed blades, having a radially varying thickness, but that a taper may also be provided on other blades if desired.

In addition, although tapered portion 18 is shown with a straight-line taper, it may advantageously have a curved transverse cross-section, e.g., a semicircular shape in a plane perpendicular to the shaft axis, although the tooling for such a blade shape would be somewhat more complex and the manufacturing process overall is believed to be more expensive. Another alternative to a straight-line taper is a stairstep taper, i.e., a series of discrete steps of incremental height extending radially out along the blade surface and thereby defining a series of discrete blade thicknesses between the axis and the outer periphery of the bit.

We claim:

1. A blunt-nosed, self-retaining screwdriver, comprising:

a tool shaft having a longitudinal axis of rotation and a tip portion; and a plurality of radially extending blades on said tip portion, at least one or said blades increasing in thickness with distance from said axis, each of said blades having an end surface which is at most slightly inclined, with respect to a plane normal to said axis, along a substantial portion of the radius of said tip portion.

2. The blunt-nosed, self-retaining screwdriver of claim 1, wherein said plurality of radially extending blades includes two diametrically opposed blades varying radially in thickness.

3. The blunt-nosed, self-retaining screwdriver of claim 2, further comprising a second pair of diametrically opposed, radially extending blades on said tip portion, said blades in said second pair arranged perpendicular to said two diametrically opposed blades in said plurality, said blades in said second pair having constant thickness.

4. The blunt-nosed, self-retaining screwdriver of claim 3, wherein said blade end surfaces are each inclined with respect to said normal plane less than 38° on average along the entire radius of said tip portion.

5. The blunt-nosed, self-retaining screwdriver of claim 4, wherein said blade end surfaces are each inclined with respect to said normal plane less than 25° on average along the entire radius of said tip portion.

6. The blunt-nosed, self-retaining screwdriver of claim 5, wherein said end surfaces are convex with a radius of curvature greater than the outer diameter of said shaft, and wherein said blades in said plurality increase in thickness with distance from said axis.

7. The blunt-nosed, self-retaining screwdriver of claim 6,. wherein each blade in said plurality has two tapered side walls.

8. The blunt-nosed, self-retaining screwdriver of claim 7, wherein said tapered side walls have a straight-line taper and an angle of approximately 12° between said side walls.

9. The blunt-nosed, self-retaining screwdriver of claim 7, wherein said tapered side walls have a curved taper.

10. The blunt-nosed, self-retaining screwdriver of claim 7, wherein said tapered side walls have a nonlinear taper.

11. The blunt-nosed, self-retaining screwdriver of claim 8, wherein the thickness of said blades in said plurality is constant at a given radial position over a predetermined axial distance.

12. The blunt-nosed, self-retaining screwdriver of claim 1, wherein said end surfaces are convex with a radius of curvature greater than the outer diameter of said shaft, and wherein each blade in said first plurality increases in thickness with distance from said axis.

13. The blunt-nosed, self-retaining screwdriver of claim 1, wherein each blade in said plurality has two tapered side walls.

14. The blunt-nosed, self-retaining screwdriver of claim 1, wherein said tapered side walls have a straight-line taper and an angle of approximately 12° between said side walls.

15. The blunt-nosed, self-retaining screwdriver of claim 1, wherein the thickness of said blades is constant at a given radial position over a predetermined axial distance.

16. The blunt-nosed, self-retaining screwdriver of claim 1, wherein said end surfaces are concave, and wherein each blade in said plurality decreases in thickness with distance from said axis.

17. A blunt-nosed, self-retaining screwdriver, comprising:

a tool shaft having a longitudinal axis and a tip portion; and a plurality of radially extending blades on said tip portion, each of said blades having a radially extending end surface which extends substantially to the radial periphery of said blade over an axial span less than the radius of said tip portion, at least one of said blades varying radially in thickness and having a thickness at said extending end surface which increases with axial distance from the extreme tip of said shaft.

18. The blunt-nosed, self-retaining screwdriver of claim 17, wherein said plurality of radially extending blades includes two diametrically opposed blades varying radially in thickness, further comprising a second pair of diametrically opposed, radially extending blades on said tip portion, said blades in said second pair arranged perpendicular to said two diametrically opposed blades in said plurality, said blades in said second pair having constant thickness.

19. The blunt-nosed, self-retaining screwdriver of claim 17, wherein the axial span of said blade end surface is less than one-fourth the radius of said tip portion.

20. The blunt-nosed, self-retaining screwdriver of claim 19, wherein said end surfaces are convex with a radius of curvature greater than the outer diameter of said shaft, and wherein said blades increase in thickness with distance from said axis.

21. The blunt-nosed, self-retaining screwdriver of claim 20, wherein each blade has two tapered side walls.

22. The blunt-nosed, self-retaining screwdriver of claim 21, wherein said tapered side walls have a straight-line taper and an angle of approximately 12° between said side walls.

23. A self-retaining screwdriver-fastener combination, comprising:

a fastener having a longitudinal axis and a low-profile slotted head including a plurality of radially extending shallow slots with slot walls generally parallel to said axis, said head having a radially extending outer surface which extends substantially to the radial periphery of said head over an axial span less than the radius of said head; and a blunt-nosed screwdriver having a shaft with a longitudinal axis and a plurality of radially extending blades on an end of said shaft, each of said blades having a radially extending end surface which extends substantially to the radial periphery of said blade over an axial span less than the radius of said shaft end, wherein at least one blade or slot has a transverse dimension which varies radially.

24. The self-retaining screwdriver-fastener combination of claim 23, wherein said walls in each slot are parallel to each other and said blades vary radially in thickness.

25. The self-retaining screwdriver-fastener combination of claim 24, wherein said outer surface of said slotted head and said end surface of said blade are both convex, and wherein said blades increase in thickness with distance from said axis.

26. The self-retaining screwdriver-fastener combination of claim 25, wherein said blades varying radially in thickness each include a pair of side walls having a straight-line taper with an angle of approximately 12° between said side walls.

27. The self-retaining screwdriver-fastener combination of claim 26, wherein said plurality of radially extending blades includes two diametrically opposed blades varying radially in thickness and said plurality of slots includes four slots, further comprising a second pair of diametrically opposed, radially extending blades, said blades in said second pair arranged perpendicular to said two diametrically opposed blades in said plurality, said blades in said second pair having constant thickness.

28. The self-retaining screwdriver-fastener combination of claim 24, wherein said outer surface of said slotted head and said end surface of said blade are both concave, and wherein said blades decrease in thickness with distance from said axis.

29. A self-retaining screwdriver-fastener combination, comprising:

a fastener having a longitudinal axis and a low-profile slotted head including a plurality of radially extending shallow slots with slot walls generally parallel to said axis, said head having a radially extending end surface; and a blunt-nosed screwdriver having a shaft with a longitudinal axis and a radially extending blade for each of said slots on an end of said shaft, each of said blades having a radially extending end surface, said shaft axis forming a common axis with said fastener axis when said screwdriver and fastener are engaged, wherein at least one blade or slot has a transverse dimension which varies radially such that the end surface of at least one of said blades is wider than an associated slot at a first distance from said common axis and narrower than said associated slot at a second distance from said common axis, and wherein at least one of said end surfaces is inclined with respect to a plane normal to said common axis and extends radially a distance approximately equal to the radius of said shaft over an axial span less than said radius.

30. The self-retaining screwdriver-fastener combination of claim 29, wherein said walls in each slot are parallel to each other and said blades vary radially in thickness.

31. The self-retaining screwdriver-fastener combination of claim 29, wherein said end surface of said slotted head and said end surface of said blade are both convex, and wherein said blades increase in thickness with distance from said axis.

32. The self-retaining screwdriver-fastener combination of claim 29, wherein said blades each include a pair of side walls having a straight-line taper with an angle of approximately 12° between said side walls.

33. The self-retaining screwdriver-fastener combination of claim 29, wherein said plurality of slots includes four slots, and wherein said blades include a first pair of diametrically opposed blades varying radially in thickness and a second pair of diametrically opposed blades arranged perpendicular to said first pair, said blades in said second pair having constant thickness.

* * * * *